US006323829B1

(12) United States Patent
Hosoi et al.

(10) Patent No.: US 6,323,829 B1
(45) Date of Patent: Nov. 27, 2001

(54) DRIVING APPARATUS FOR PLASMA DISPLAY PANEL

(75) Inventors: Kenichiro Hosoi; Mitsushi Kitagawa; Nozomu Kikuchi, all of Fukuroi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/102,930

(22) Filed: Jun. 24, 1998

(30) Foreign Application Priority Data

Aug. 1, 1997 (JP) ..... 9-207468

(51) Int. Cl.[7] ..... G09G 3/20
(52) U.S. Cl. ..... 345/60; 345/210; 345/211
(58) Field of Search ..... 345/60, 210, 211

(56) References Cited

U.S. PATENT DOCUMENTS 5,909,199 * 6/1999 Miyazaki et al. ..... 345/60
5,943,030 * 8/1999 Minamibayashi ..... 345/60

FOREIGN PATENT DOCUMENTS 2 741 741 5/1997 (FR) ..... G09G/3/28

* cited by examiner

*Primary Examiner*—Richard Hjerpe
*Assistant Examiner*—Jean Lesperance
(74) *Attorney, Agent, or Firm*—Sughrue, Mion, Zinn, Macpeak & Seas, PLLC

(57) ABSTRACT

In a plasma display having a charge recovery type of pulse generator for generating a driving pulse, the charge recovery type of pulse generator is prevented from short-circuiting due to a malfunction of a switch controller in a driving apparatus. A protection gate circuit is provided between the charge recovery type of pulse generator and the switch controller to block an undesirable signal generated due to a malfunction of switch controller for turning on an undesirable switch.

5 Claims, 7 Drawing Sheets

PRIOR ART

PRIOR ART

DRIVING APPARATUS FOR PLASMA DISPLAY PANEL

BACKGROUND OF THE INVENTION

1. Field of the Invention

This invention relates to a driving apparatus for a plasma display panel.

2. Description of the Related Art

A plasma display panel (designated as "PDP" hereinafter) is well known, as a display panel which relatively readily achieves a reduction in thickness and an increase in screen size. There is a need for a reduction in manufacturing cost and power consumption of the plasma display panel.

FIG. 1 is a block diagram illustrating an AC discharge type of a PDP 10, which comprises a group of X-row electrodes including X-row electrodes $X_1, X_2, X_3, \ldots, X_n$; a group of Y-row electrodes including Y-row electrodes $Y_1, Y_2, Y_3, \ldots, Y_n$, each of which pairs with a corresponding one of the X-row electrodes; and a group of column electrodes including column electrodes $D_1, D_2, D_3, \ldots, D_m$ which are orthogonal to the X-row and the Y-row electrode groups. At an intersection of one column electrode and one pair of row electrodes, a discharge cell 9 filled with a discharge gas is formed for emitting light for a desired display in response to a pulse applied to the electrodes.

In the operation of the PDP 10 as described above, a scanning pulse is first applied to the X-row electrode, and a data pulse is simultaneously applied to the column electrode to perform a write discharge between the X-row electrode and the column electrode. Therefore, a sustain pulse is applied alternately to the X-row electrode and the Y-row electrode in each pair to keep light emission, so that a sustaining discharge can be maintained.

The sustaining discharge is performed by charging and discharging a static capacitance between the electrodes in the cell. The majority of the light emission of the discharge cell relies then on the sustaining discharge. For this reason, the power consumption of the entire PDP depends largely on electric power which is consumed during sustaining discharge periods. Particularly, for driving a larger-size panel, the static capacitance between the electrodes in the pair is increased, and a larger size of a driving power supply is required, which consequently leads to an increase in power consumption of the entire PDP apparatus.

To prevent increased power consumption in the PDP apparatus, a charge recovery type of driving circuit has been proposed for reducing electric power consumed for the sustaining discharge by recovering reactive power lost by a discharge during a sustaining discharge period to reuse the recovered reactive power for charging.

Referring to FIG. 2, a group of X-row electrodes X (which corresponds to the group of X-row electrodes $X_1$–$X_n$ of FIG. 1 connected with each other) is connected to a charge recovery type of circuit 20 for generating a sustain pulse. A driving circuit 21 for driving the Y-row electrodes includes a charge recovery type of generator for generating a sustain pulse, and another generator for generating a scanning pulse, an erasing pulse and a reset pulse as generators for producing a driving pulse (not shown).

FIG. 3 illustrates a timing chart for a sustain pulse generated by the charge recovery type of generator 20. The following description will be made for explaining a process for generating a sustain pulse during a sustaining discharge period with reference to FIGS. 2 and 3.

First, in period $t_1$, switches SW1, SW2 and SW4 shown in FIG. 2 are turned off, while a switch SW3 of FIG. 2 is turned on. Therefore, the group of X-row electrodes has a potential level maintained at a ground (GND) level.

Next, as the switch SW3 is turned off and the switch SW1 is turned on, a discharge cell of the PDP is supplied with a charging current for a charge recovery type of capacitor C1 through a coil L1 and a diode D1 (in period $t_2$). Subsequently, as the switch SW1 is turned off and the switch SW4 is turned on, the potential level of the group of X-row electrodes is maintained at a level of a sustain pulse voltage $V_D$ which is supplied from a power supply 22 (in period $t_3$).

Next, as the switch SW4 is turned off and the switch SW2 is turned on, a discharging current from the discharge cell of the PDP is charged on the capacitor C1 through a coil L2 and a diode D2 (in period $t_4$). Subsequently, as the switch SW2 is turned off and the switch SW3 is turned on, the group of X-row electrodes is maintained at the GND level (in period $t_5$).

By repeating the foregoing operations, a series of sustain pulses can be supplied to the group of X-row electrodes. The Y-row electrode is supplied with a series of sustain pulses produced by similar operations. However, it should be understood that a generating timing for the Y-row electrode is shifted by a half cycle from that of the X-row electrode, thereby providing surface discharge between the pair of X-row electrode and Y-row electrode.

A problem arises in the conventional charge recovery type of generator for generating a sustain pulse in that such a generator tends to be short-circuited, if noise from the outside or a malfunction in a controller for controlling the switches results in generating a signal which may turn on the switch SW3 to maintain the row electrodes at the GND level in the period $t_3$ the row electrodes are maintained at the level of the sustain pulse voltage $V_D$.

OBJECT AND SUMMARY OF THE INVENTION

The present invention features a driving apparatus comprising a protection gate circuit provided between a charge recovery type of pulse generator and a switch controller for controlling switches in the charge recovery type of pulse generator for relaying only one signal for turning on one switch from the switch controller to the pulse generator.

BRIEF DESCRIPTION OF THE DRAWINGS

The aforementioned aspects and other features of the invention are explained in the following description, taken in connection with the accompanying drawing figures wherein.

DESCRIPTION OF THE PREFERRED EMBODIMENTS

The present invention will be described in detail based on the preferred embodiments thereof with reference to the accompanying drawings.

Figure 1:
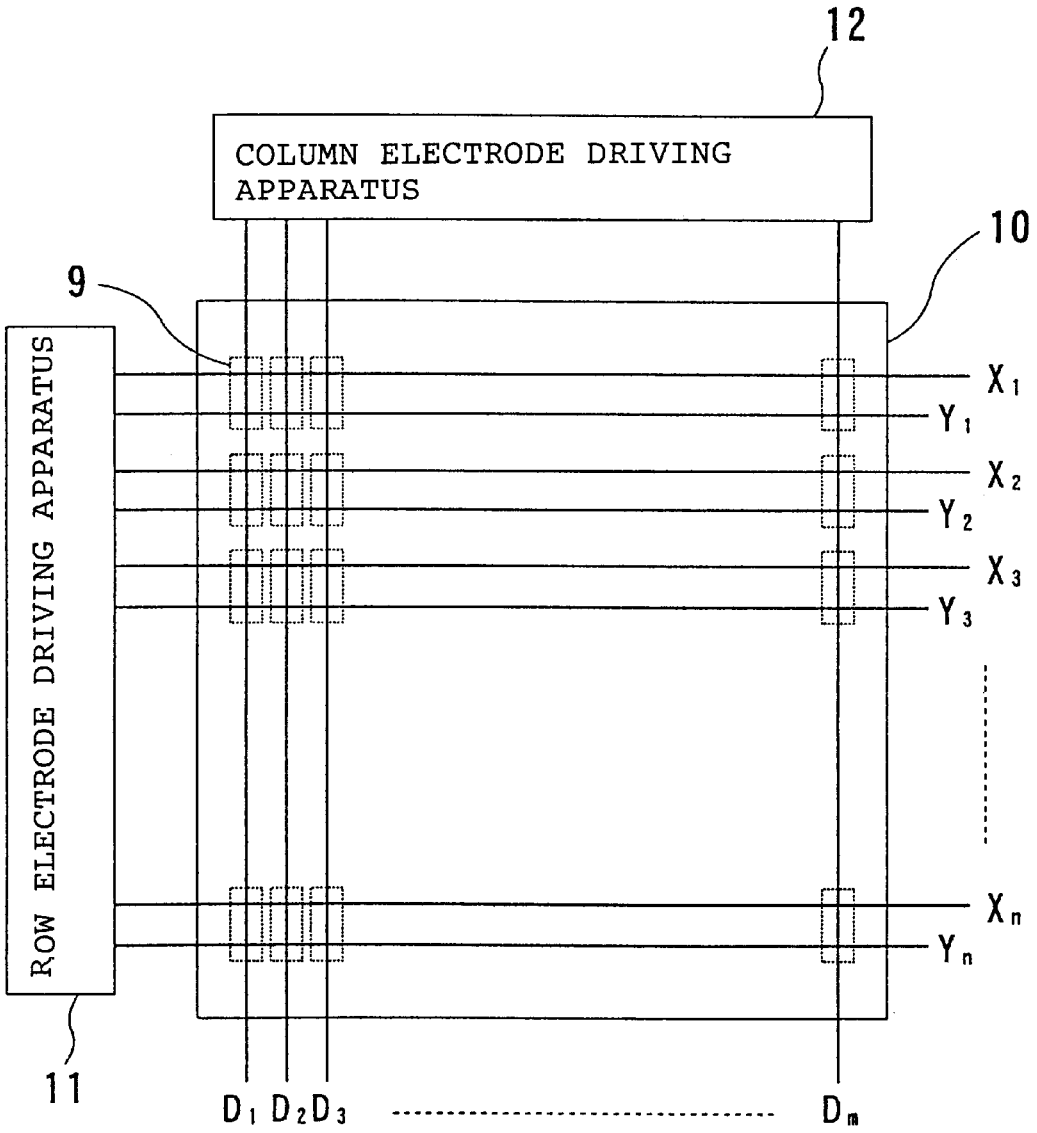
FIG. 1 is a plan view illustrating the structure of electrodes in a plasma display panel.
Figure 2:
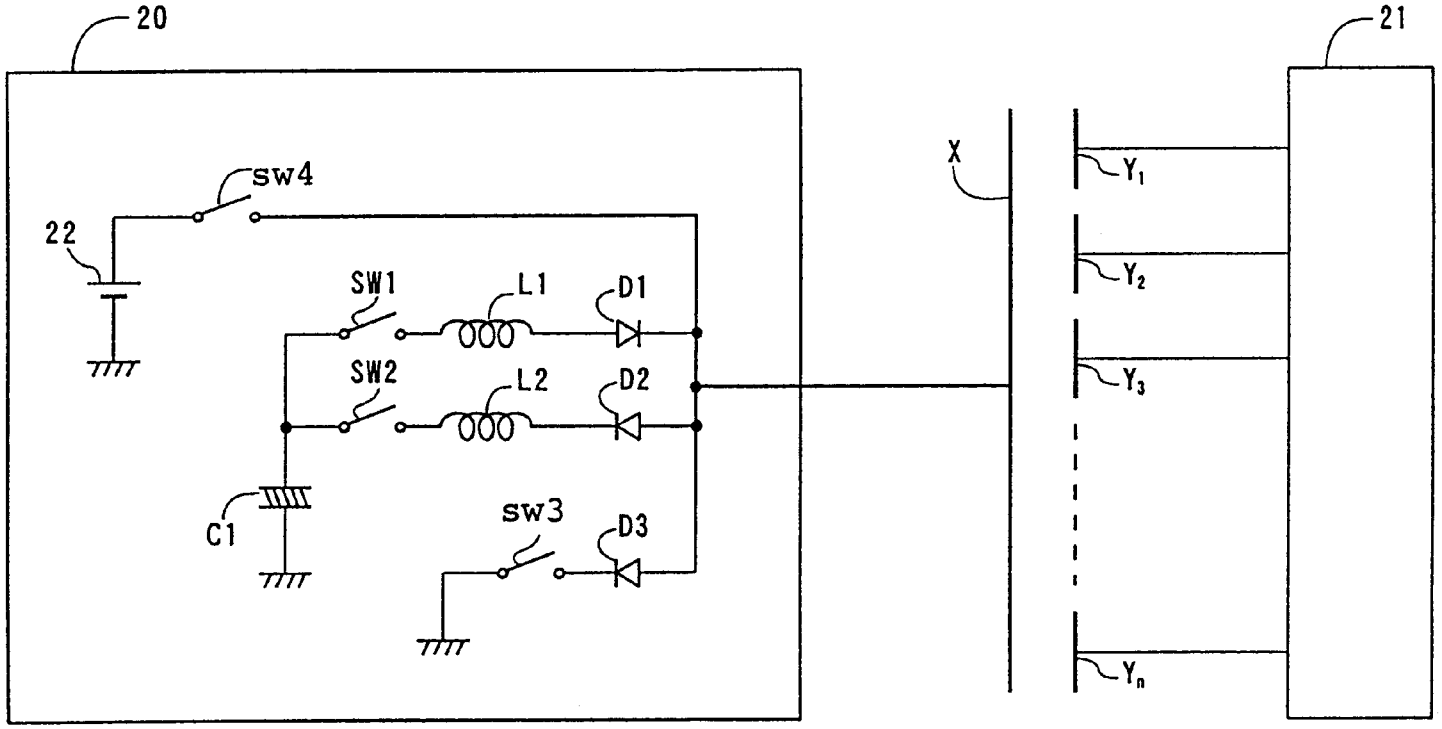
FIG. 2 is a schematic diagram illustrating a conventional charge recovery type of pulse generator for generating a sustain pulse.
Figure 3:
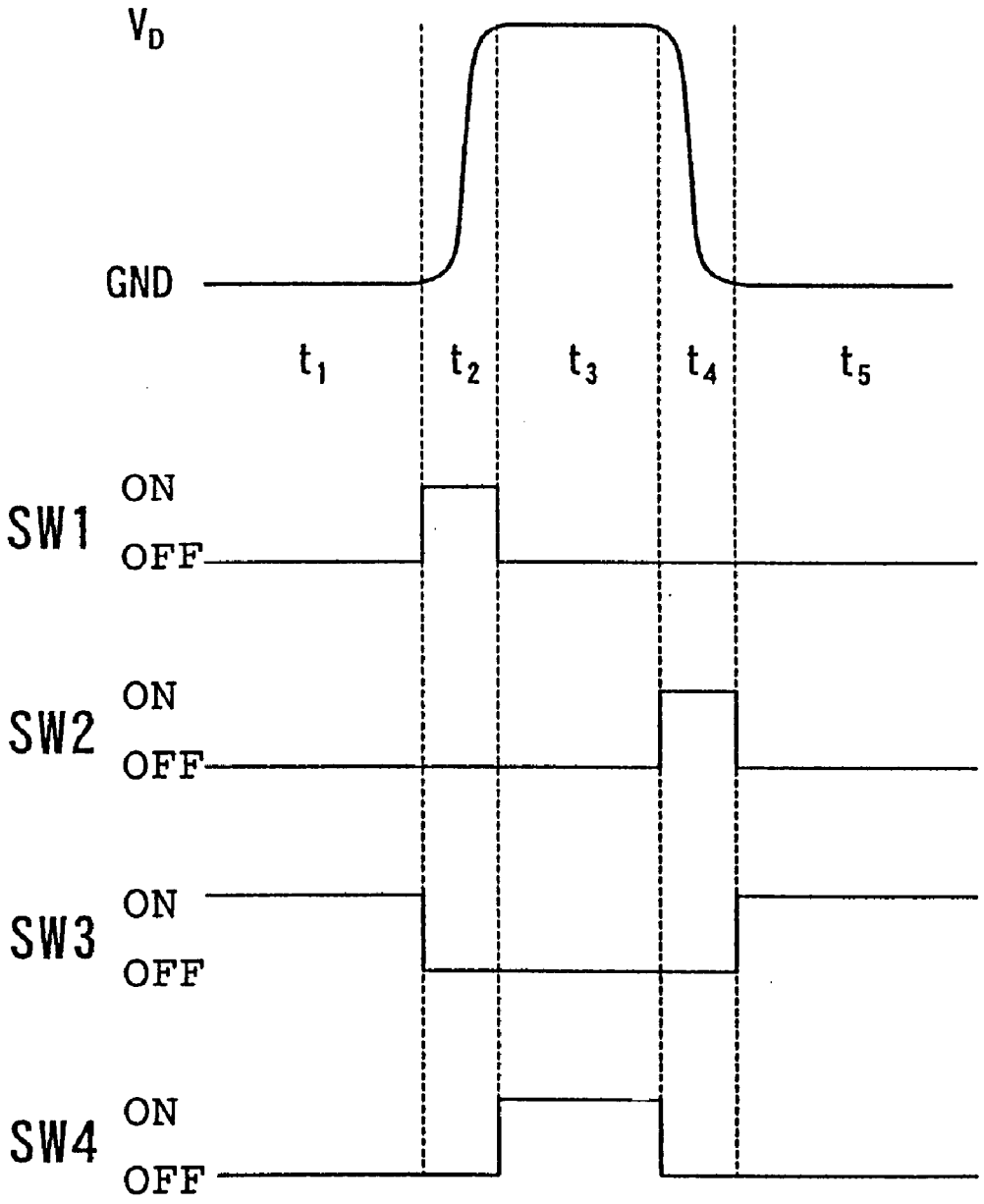
FIG. 3 illustrates a timing chart for generating a sustain pulse in a charge recovery type of pulse generator.
Figure 4:
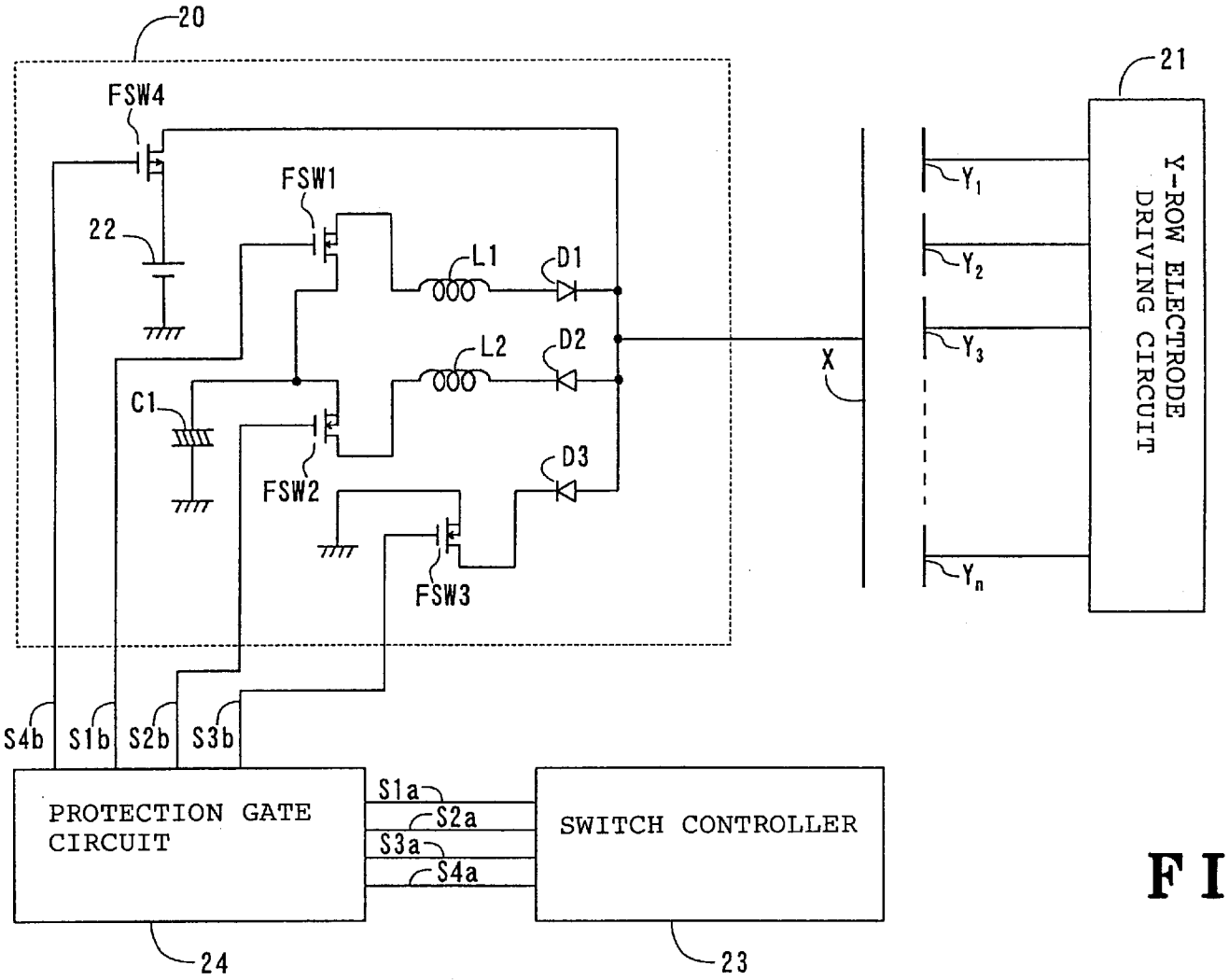
FIG. 4 is a block diagram illustrating a driving apparatus for a plasma display panel according to the present invention.

FIG. 4 illustrates a block diagram showing a driving apparatus according to one embodiment of the present invention. The driving apparatus comprises a pulse generator 20 for a group of X-row electrodes, a driving unit 21 for a group of Y-row electrodes $Y_1$, $Y_2$, . . . $Y_n$, a switching controller 23 for controlling the pulse generator 20, and a protection gate circuit 24 provided between the pulse generator 20 and the switching controller 23.

The pulse generator 20 consists of a charge recovery type of pulse generator for producing a sustain pulse. The pulse generator 20 is connected to a group of X-row electrodes X comprising a plurality of x-row electrodes. Each of Y-row electrodes $Y_1$, $Y_2$, . . . $Y_n$ is paired with the corresponding one of the X-row electrodes, are connected to the driving circuit 21 for driving the Y-row electrodes.

The pulse generator 20 comprises a DC power supply 22, two coils L1 and L2, three diodes D1–D3, a capacitor C1, and four switches FSW1–FSW4 consisting of FETs. The power supply 22 and the switch FSW4 are connected in series. The FSW1, the coil L1, and the diode D1 are connected in series. The FSW2, the coil L2, and the diode D2 are connected in series. The capacitor C1 is connected to the switches FSW1 and FSW2. The diode D3 and the switches FSW3 are connected in series. A drain of the switch FSW4, a cathode of the diode D1, and anodes of the diodes D2, D3 are connected to the group of X-row electrodes together.

The switching controller 23 generates signals for controlling the switches FSW1–FSW4 to supply the signals through four lines S1a, S2a, S3a, S4a connected to the protection gate circuit 24.

The protection gate circuit 24 has four control signal lines connecting gates of the switches FSW1–FSW4 for supplying the signal, respectively. Here, there is a predetermined relationship between the lines S1a–S4a and S1b–S4b and the switches FSW1–FSW4. Accordingly, a signal for the switch FSW1 is supplied from the switch controller 23 to the switch FSW1 through the signal lines S1a and S1b. A signal for the switch FSW2 is supplied from the switch controller 23 to the switch FSW2 through the signal lines S2a and S2b. A signal for the switch FSW3 is supplied from the switch controller 23 to the switch FSW3 through the signal lines S3a and S3b. A signal for the switch FSW4 is supplied from the switch controller 23 to the switch FSW4 through the signal lines S4a and S4b.

The driving circuit 21 also includes a charge recovery type of generator for generating a sustain pulse for the Y-row electrode, and another generator for generating a driving pulse including a scanning pulse, an erasing pulse and a reset pulse (not shown).

Figure 5:
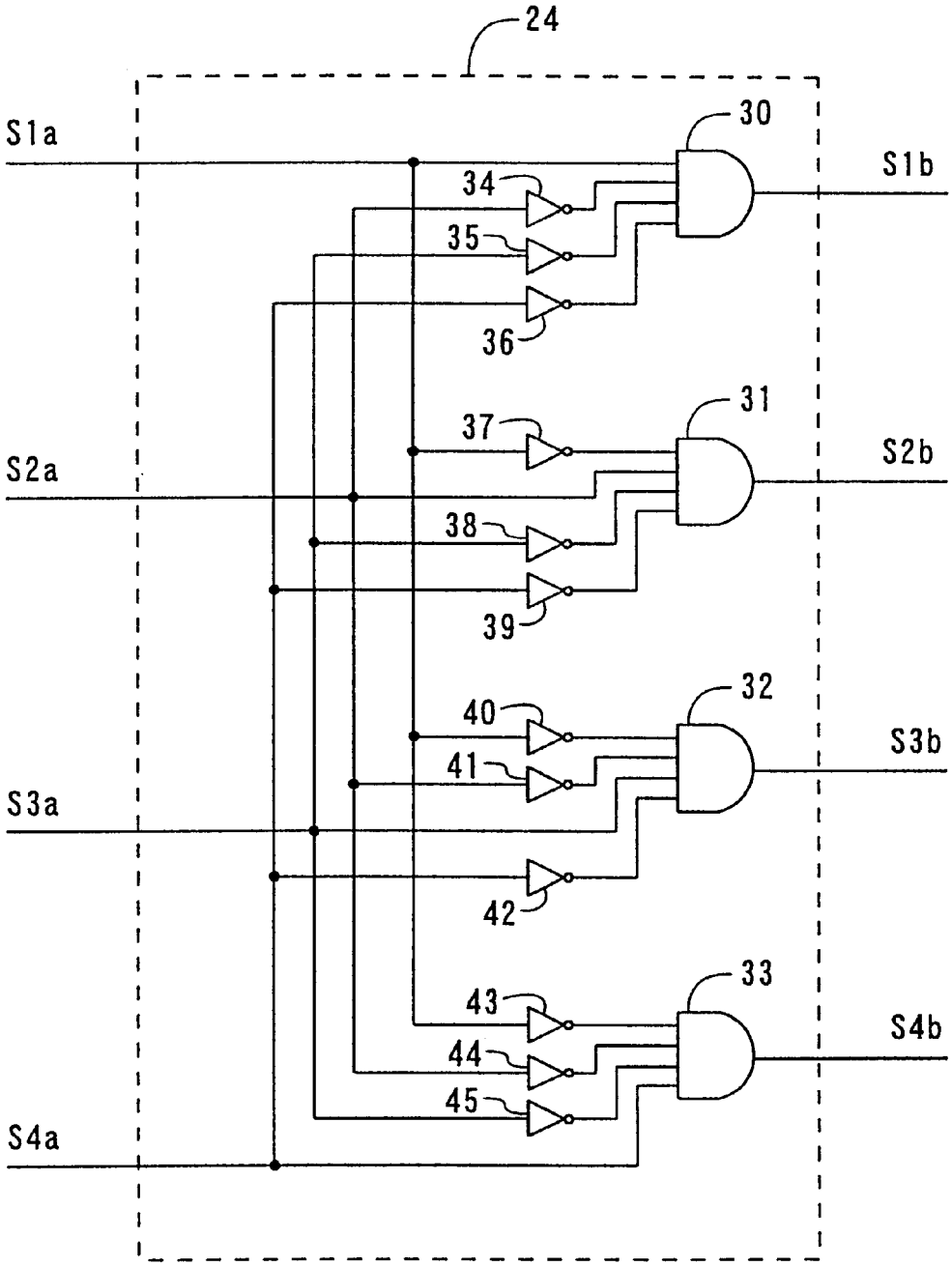
FIG. 5 is a logical circuit diagram illustrating a first embodiment of a protection gate circuit according to the present invention.

FIG. 5 is a logical circuit diagram illustrating a first embodiment of the protection gate circuit. In the following, the operation of this circuit will be described with reference to a timing chart of FIG. 6.

Figure 6:
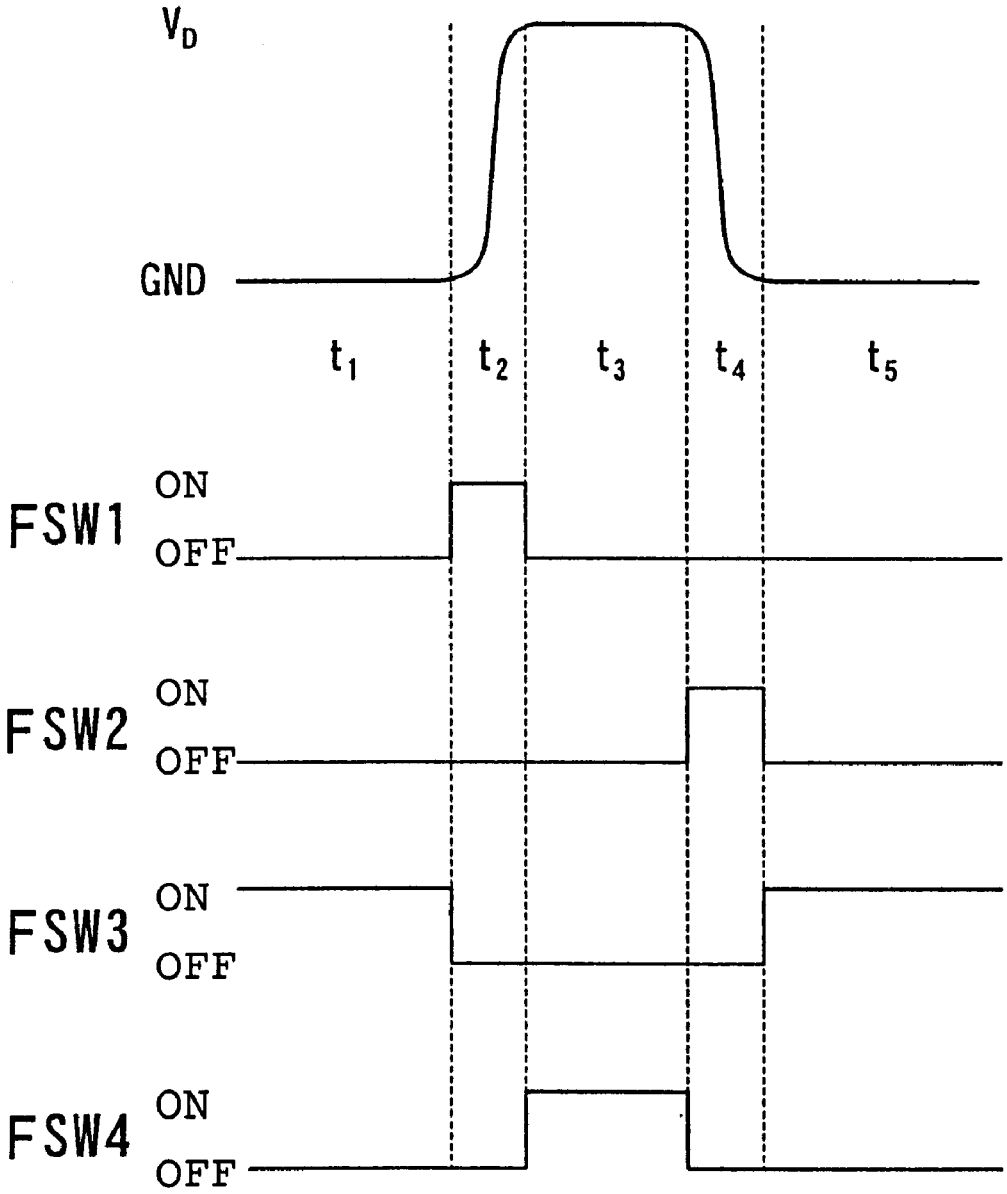
FIG. 6 illustrates a timing chart for generating a sustain pulse in a charge recovery type of pulse generator shown in FIG. 4.

Assume first that the protection gate circuit 24 receives a normal switch control signal free of malfunction and external noise. Referring to FIG. 6, in a period $t_1$, signals on the signal input lines S1a–S4a to the protection gate circuit have levels of "low", "low", "high", "low", respectively. Accordingly, the signals on the lines S1a, S2a, S4a intend to turn off FSW1, FSW2, FSW4, respectively, and the signal on the line S3a intends to turn on FSW3. An AND gate 30 receives the signal having a "low" level from the line S1a and the signals having "high", "low", "high" levels supplied from the lines S2a–S4a and inverted by inverters 34–36, respectively. Thus, the AND gate 30 supplies a signal having a "low" level, which is supplied to the gate of the FET switch FSW1 to turn the switch FSW1 off. An AND gate 31 receives the signal having a "low" level from the line S2a and the signal having "high", "low", "high" levels supplied from the lines S1a, S3a, S4a and inverted by inverters 37–39, respectively. Thus, the AND gate 31 supplies a signal having a "low" level, which is supplied to the gate of the FET switch FSW2 to turn the switch FSW2 off. An AND gate 32 receives the signal from the line S3a and the signals supplied from the lines S1a, S2a, S4a and inverted by inverters 40–42, all of which having "high" levels. Therefore, the AND gate 32 supplies a signal having a "high" level, which is supplied to a gate of the FET switch FSW3 to turn on the switch FSW3. An AND gate 33 receives the signal having a "low" level from S4a and the signals having "high", "high", "low" levels supplied from S1a–S3a and inverted by inverters 43–45, respectively. Thus, the AND gate 33 supplies a signal having a "low" level, which is supplied to a gate of the FET switch FSW4 to turn off the switch FSW4.

From the foregoing, signals S1b–S4b from the protection gate circuit 24 in period $t_1$ have "low", "low", "high", "low" levels, respectively, which are the same as those of the switch control signals S1a–S4a from the switch control circuit 23, respectively. In the remaining periods $t_2$–$t_5$, when a normal switch control signal is received, the same signals as those from the switch control circuit 23 are supplied to the respective FET switch by the similar operations to the foregoing.

Next description will be made for explaining the operation of the protection gate circuit 24 receiving an abnormal switch control signal due to a malfunction of the switch control circuit or external noise. For example, if the switch control signals "low", "low", "low", "high" on S1a–S4a in period $t_3$ in FIG. 6 are collapsed to "low", "low", "high", "high", in other words, if the signal on S3a which should be essentially at "low" level is collapsed to a "high" level and supplied to the protection gate circuit 24, the AND gate 30 receives a signal having a "low" level from S1a and signals having "high", "low", "low" supplied from S2a–S4a and inverted by the inverters 34–36, respectively. Thus, the AND gate 30 supplies a signal having a "low" level, which is supplied to the gate of the FET switch FSW1 to turn off the switch FSW1.

The AND gate 31 receives a signal having a "low" level from S2a and signals having "high", "low", "low" levels supplied from S1a, S3a, S4a and inverted by the inverters 37–39, respectively. Thus, the AND gate 31 supplies a signal having a "low" level, which is supplied to the gate of the FET switch FSW2 to turn off the switch FSW2.

The AND gate 32 receives a signal having a "high" level from S3a and signals having "high", "high", "low" levels supplied from S1a, S2a, S4a and inverted by the inverters 40–42. Thus, the AND gate 32 supplies a signal having a "low" level, which is supplied to the gate of the FET switch FSW3 to turn the switch FSW3 off.

The AND gate 33 receives a signal having a "high" level from S4a and signals having "high", "high", "low" levels supplied from S1a–S3a and inverted by the inverters 43–45, respectively. Thus, the AND gate 33 supplies a signal having a "low" level, which is supplied to the gate of the FET switch FSW4 to turn off the switch FSW4.

From the foregoing, the protection gate circuit 24 in period $t_3$ supplies signals having only "low" levels. The switch control signals having "high" levels on S3a and S4a from the switch control circuit 23 are both changed to "low" levels, which are supplied to the gates of the FET switches FSW3 and FSW4. In other words, the logical circuit of FIG. 5 forces all of the switch control signals to have "low" levels in order to turn off all of the switches, if a control signal having a "high" level is supplied from the switch controller to any switch other than one which must be turned on. In this way, it is possible to avoid one or more switches which should be closed in accordance with the timing chart of FIG. 6 from simultaneously turning on.

Next, a logical circuit illustrated in FIG. 7 will be described as a second embodiment of the protection gate circuit in a manner similar to the first embodiment. Assume first that the protection gate circuit 24 receives a normal switch control signal free of malfunction and external noise. In period $t_1$ in FIG. 6, signal on the signal input lines S1a–S4a to the protection gate circuit have "low", "low", "high", "low" levels, respectively. The signals on the lines S1a, S2a, S4a tend to turn the switches FSW1, FSW2, FSW4 off, respectively, and the signal on the line S3a tends to turn on the switch FSW3.

Figure 7:
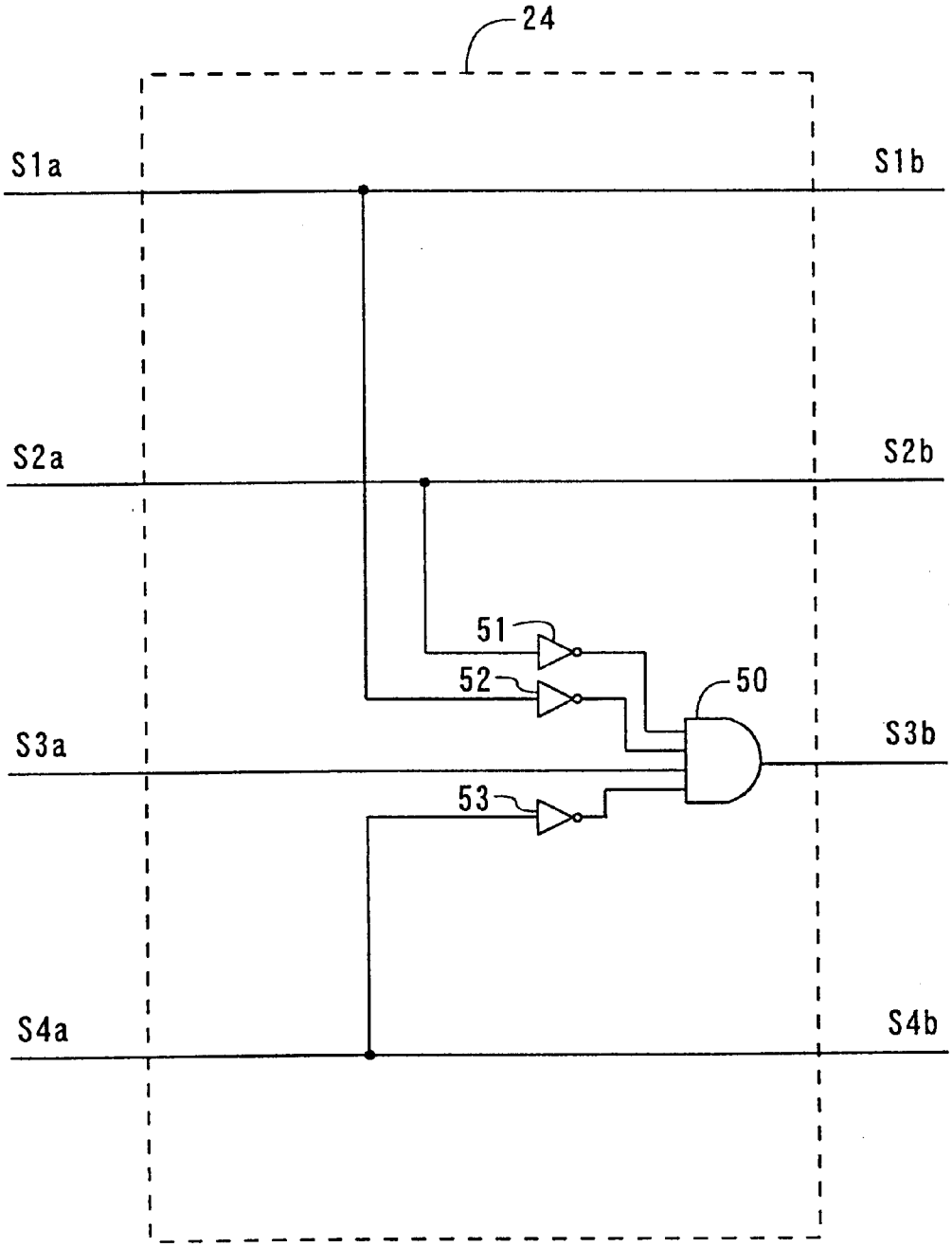
FIG. 7 is a logical circuit diagram illustrating a second embodiment of the protection gate circuit according to the present invention.

Referring to FIG. 7, the lines S1a, S2a, S4a are connected to the line S1b, S2b, S4b, respectively, and switch control signals from the switch control circuit are directly supplied to the gates of the respective FET switches FSW1, FSW2, FSW4. A signal to the FET switch FSW3 is supplied directly from an output terminal of an AND gate 50. In the AND gate 50, all of a signal from the line S3a and signals supplied from the lines S1a, S2a, S4a and inverted by inverters 51–53 have "high" levels. Therefore, the AND gate 50 supplies a signal having a "high" level, which is supplied to a gate of the FET switch FSW3 to turn on the switch FSW3. Thus, signals on the lines S1b–S4b from the protection circuit 24 in period $t_1$ have "low", "low", "high", "low" levels, respectively, which are the same as those of the switch control signals S1a–S4a supplied from the switch control circuit 23. Also, in the remaining periods $t_2$–$t_5$, when the protection gate circuit 24 receives a normal switch control signal, the same signals as those from the switch control circuit are supplied to the respective FET switches by similar operations to the foregoing.

Next, consider that the protection gate circuit 24 receives an abnormal switch control signal causing FSW3 to turn on due to a malfunction of the switch control circuit or external noise in a period in which FSW3 should not be turned on in order to prevent the pulse generator 20 from short circuiting.

Similarly to the first embodiment, if the levels of the switch control signals, "low", "low", "low", "high" on S1a–S4a in period $t_3$ in FIG. 6 are collapsed to levels "low", "low", "high", "high", the AND gate 50 receives a signal having a "high" level from the line S3a and signals having "high", "high", "low" levels supplied from the lines S1a, S2a, S4a and inverted by the inverters 51–53, respectively. The AND gate 50 then supplies a signal having a "low" level, which is supplied to the gate of the FET switch FSW3 to turn off the switch FSW3. Thus, the protection gate circuit 24 in period $t_3$ supplies signals S1b–S4B having "low", "low", "low", "high" levels, respectively. It can be seen that the malfunctioned switch control signal having a wrong "high" level on S3a from the switch control circuit 23 is corrected to have a correct "low" level, which is supplied to the gate of the FET switch FSW3. In other words, the logical circuit of FIG. 7 particularly monitors the FET switch FSW3 which is likely to provide a fatal operation for a sustain pulse generator. The logical circuit then prohibits the supply of a signal for turning a switch FSW3 on to the gate of FSW3 in a period other than the period in which FSW3 should be turned on. In this way, it is possible to avoid an unintentional short-circuiting state for the sustain pulse generator, thereby supplying a normal switch control signal to the sustain pulse generator circuit.

The logical circuits illustrated in the foregoing first and second embodiments may be implemented by equivalent circuits using, for example, OR gates. In addition, the control signals from the switch control circuit may be monitored by a program executed by a microcomputer, in place of the logical circuits, to supply the FET switches with a normal switch signal.

As described above, by providing the protection gate circuit between the charge recovery type of sustain pulse generator and the switch controller for supplying switch control signals to the switches in the sustain pulse generator circuit, it is possible to prohibit an erroneous switch control circuit due to a malfunction of the switch control circuit from being supplied to an associated switching element. Particularly, it is possible to prevent the charge recovery type of sustain pulse generator from short-circuiting at an undesirable timing for the sustain pulse generator.

Thus, the present invention has been described with reference to the preferred embodiments thereof. It should be understood that a variety of modifications and alterations may be thought of by those skilled in the art without departing from the spirit and scope of the present invention. All such modifications and alternations are intended to be encompassed by the appended claims.

What is claimed is:

1. An apparatus for driving a plasma display panel comprising row electrodes extending horizontally in parallel with each other and column electrodes extending perpendicularly to said row electrodes through a discharge space sealed with discharge gas, said apparatus comprising:

a pulse generator for generating a predetermined driving pulse for driving one row electrode of said row electrodes, wherein said predetermined driving pulse is applied to said row electrode, said pulse generator including a first switch provided between said row electrode and a first terminal applied with a predetermined potential, and a second switch provided between said row electrode and a second terminal applied with a reference potential;

controlling means for consecutively generating a first switch control pulse for turning on said first switch, and a second switch control pulse for turning on said second switch at a predetermined timing; and relaying means for relaying said first and second switch control pulses while preventing a pulse duration of said second switch control pulse from overlapping a pulse duration of said first control switch pulse.

2. The apparatus according to claim 1, wherein said means for converting comprises means for forcibly turning off all of said first and second switches if either one of said first and second switch control pulses is generated during a period in which the other is supplied from said controlling means to the corresponding switch.

3. An apparatus for driving a plasma display panel comprising row electrodes extending horizontally in parallel with each other, and column electrodes extending perpendicularly to said row electrodes through a discharge space sealed with discharge gas, said apparatus comprising:

driving means connected to one row electrode of said row electrodes, said driving means including a capacitor, a first switch having one end connected to said capacitor and the other end connected to said row electrode through a first diode, said first diode permitting a current from said capacitor to said row electrode, a second switch having one end connected to said capacitor and the other end connected to said row electrode through a second diode, said second diode permitting a current from said row electrode to said capacitor, a third switch connected between a reference potential and said row electrode, and a fourth switch connected between a predetermined potential and said row electrode, a controller for generating a switch control signal for turning on only one of said first, second, third and fourth switches, and protecting means for preventing an erroneous switch control signal from being supplied to said first, second, third and fourth switches, said protecting means including means for monitoring said switch control signal and means for converting said switch control signal into a signal for forcibly turning off all of said first, second, third and fourth switches if said switch control signal directs the closure of at least two of said first, second, third and fourth switches.

4. An apparatus for driving a plasma display panel comprising row electrodes extending horizontally in parallel with each other, and column electrodes extending perpendicularly to said row electrodes through a discharge space sealed with discharge gas, said apparatus comprising:

driving means connected to one row electrode of said row electrodes, said driving means including a capacitor, a first switch having one end connected to said capacitor and the other end connected to said row electrode through a first diode, said first diode permitting a current from said capacitor to said row electrode, a second switch having one end connected to said capacitor and the other end connected to said row electrode through a second diode, said second diode permitting a current from said row electrode to said capacitor, a third switch connected between a reference potential and said row electrode, and a fourth switch connected between a predetermined potential and said row electrode, a controller for consecutively generating a first switch control pulse for turning said first switch, a second switch control pulse for turning on said second switch, a third switch control pulse for turning on said third switch and a fourth switch control pulse for turning on said fourth switch, and relaying means for relaying said first, second, third, and fourth switch control pulses to said first, second, third, and fourth switches, respectively, while preventing a pulse duration of aid third switch control pulse from overlapping a pulse duration of any one of said first, second, and fourth switch control pulses.

5. An apparatus for driving a plasma display panel comprising row electrodes extending horizontally in parallel with each other, and column electrodes extending perpendicularly to said row electrodes through a discharge space sealed with discharge gas, said apparatus comprising:

driving means connected to one row electrode of said row electrodes, said driving means including a capacitor, a first switch having one end connected to said capacitor and the other end connected to said row electrode through a first diode, said first diode permitting a current from said capacitor to said row electrode, a second switch having one end connected to said capacitor and the other end connected to said row electrode through a second diode, said second diode permitting a current from said row electrode to said capacitor, a third switch connected between a reference potential and said row electrode, and a fourth switch connected between a predetermined potential and said row electrode, a controller for generating a switch control signal for turning on alternate ones of said first, second, third and fourth switches, and protecting means for preventing an erroneous switch control signal from being supplied to said first, second, third and fourth switches, said protecting means including means for monitoring said switch control signal and means for converting said switch control signal into a signal for forcibly turning off all of said first, second, third and fourth switches if said switch control signal directs the closure of at least two of said first, second, third and fourth switches.

* * * * *